US011143070B2

(12) United States Patent
Unbehaun

(10) Patent No.: US 11,143,070 B2
(45) Date of Patent: Oct. 12, 2021

(54) MUFFLER FOR AN EXHAUST SYSTEM OF AN INTERNAL COMBUSTION ENGINE

(71) Applicant: Faurecia Emissions Control Technologies, Germany GmbH, Augsburg (DE)

(72) Inventor: Martin Unbehaun, Augsburg (DE)

(73) Assignee: Faurecia Emissions Control Technologies, Germany GmbH

( * ) Notice: Subject to any disclaimer, the term of this patent is extended or adjusted under 35 U.S.C. 154(b) by 375 days.

(21) Appl. No.: 16/426,227

(22) Filed: May 30, 2019

(65) Prior Publication Data

US 2019/0368396 A1 Dec. 5, 2019

(30) Foreign Application Priority Data

May 30, 2018 (DE) ..... 10 2018 112 963.7

(51) Int. Cl.
*F01N 1/02* (2006.01)
*F01N 1/00* (2006.01)
(Continued)

(52) U.S. Cl.
CPC ..... *F01N 1/023* (2013.01); *F01N 1/003* (2013.01); *F01N 1/04* (2013.01); *F01N 1/08* (2013.01);
(Continued)

(58) Field of Classification Search
CPC ... F01N 1/02; F01N 1/023; F01N 1/04; F01N 2470/02; F01N 2470/04; F01N 2470/20; F02M 35/1261
See application file for complete search history.

(56) References Cited

U.S. PATENT DOCUMENTS 4,841,728 A * 6/1989 Jean ..... F01N 1/003 181/247
2007/0205045 A1* 9/2007 Leng ..... F01N 1/003 181/257
2017/0241311 A1 8/2017 Bogard et al.

FOREIGN PATENT DOCUMENTS

DE 3807948 A1 9/1989
DE 10254631 A1 6/2004
(Continued)

*Primary Examiner* — Jonathan R Matthias
(74) *Attorney, Agent, or Firm* — Carlson, Gaskey & Olds, P.C.

(57) ABSTRACT

A muffler for an exhaust system of an internal combustion engine includes a housing, a through pipe that conducts exhaust gas during operation of the muffler and is guided through the housing, and a branch pipe fluidically branching off from the through pipe within the housing. The branch pipe has an upstream end at the through pipe and ends freely and open at an end face with a downstream end within the housing. The branch pipe has a length from the upstream to the downstream end or up to a lateral recess which has a cross-sectional area which is greater than half a pipe cross-section of the branch pipe. The branch pipe has downstream perforations in a section from ⅜ of the length as measured from the upstream end A total area of the downstream perforations is smaller than half the pipe cross-section of the branch pipe, and no perforations or upstream perforations have a total area of at most 10% of the pipe cross-section of the branch pipe being present in a section before ⅜ of the length.

20 Claims, 10 Drawing Sheets

(51) Int. Cl.
*F01N 1/08* (2006.01)
*F01N 1/04* (2006.01)

(52) U.S. Cl.
CPC ..... *F01N 2470/04* (2013.01); *F01N 2470/20* (2013.01)

(56) References Cited

FOREIGN PATENT DOCUMENTS

| | | | | | |
|---|---|---|---|---|---|
| DE | 102006008941 | A1 | | 8/2007 | |
| DE | 102007007600 | A1 | * | 8/2008 | ..... F01N 1/023 |
| DE | 102016103466 | A1 | | 8/2017 | |
| EP | 2955344 | B1 | | 12/2016 | |
| FR | 738654 | A | * | 12/1932 | ..... F01N 1/24 |
| JP | H078516 | U | | 2/1995 | |

* cited by examiner

MUFFLER FOR AN EXHAUST SYSTEM OF AN INTERNAL COMBUSTION ENGINE

CROSS-REFERENCE TO RELATED APPLICATIONS

This application is a U.S. non-provisional application claiming the benefit of German Patent Application No. 10 2018 112 963.7, filed on May 30, 2018, which is incorporated herein by its entirety.

FIELD OF INVENTION

The present invention relates to a muffler for an exhaust system of an internal combustion engine, in particular for a motor vehicle.

BACKGROUND OF THE INVENTION

Exhaust systems for internal combustion engines often include mufflers in order to reduce disturbing noises, in particular charge exchange noises. For this purpose, mufflers may be provided with branch pipes. Such mufflers usually have a Helmholtz resonator or a bypass muffler.

However, depending on flow velocity and temperature, such branch pipes tend to produce undesired whistling noises. Such noises can be very annoying and are difficult to predict in the development phase, as they partly occur only under certain driving conditions, for example after a cold start and at an engine load of 80%.

In order to reduce disturbing noises, sharp edges in the exhaust gas flow path are avoided. However, this is not always possible or associated with very high costs. For example, the use of half shells or hydroformed pipes may be required to avoid sharp edges.

To make things worse, the sharp-edged form of a decisive edge in the production process can vary, and the disturbing noises in the exhaust systems can therefore also vary considerably. It is therefore difficult to ensure a constant good quality of the exhaust systems in terms of noise generation.

A further possibility to avoid flow noises is to avoid resonances, because a resonance body, which can for example be constituted by a pipe, is always required for the generation of a whistling noise.

Thus, a muffler for an exhaust system of an internal combustion engine should have reduced disturbing whistling noises.

SUMMARY OF THE INVENTION

A muffler for an exhaust system of an internal combustion engine, in particular for a motor vehicle, includes a housing, a through pipe which conducts exhaust gas during operation of the muffler and is guided through the housing, and a branch pipe fluidically branching off from the through pipe within the housing. The branch pipe has an upstream end at the through pipe and ends freely and open at an end face with a downstream end within the housing. The branch pipe has a length L from the upstream to the downstream end, and perforations (called downstream perforations) are provided in a section from ⅜ of the length L, as measured from the upstream end, wherein a total area of all downstream perforations together is smaller than half the pipe cross-section of the branch pipe, preferably the largest pipe cross-section, and wherein in a section upstream of ⅜ of the length L, no perforations are present. Alternatively, perforations are present in the upstream section, i.e. before ⅜L, but all these perforations, called upstream perforations, added together have a total area of at most 10% of the pipe cross-section of the branch pipe. The pipe cross-section is measured in radial planes to the center line (also called central axis) of the branch pipe. The length L is measured at the center line of the branch pipe. Therefore, there are either no perforations at all in the upstream end area of the branch pipe from 0 to ⅜ of the length L, or a few perforations, so-called upstream perforations, are arranged in a section from 0 to ⅜ of the length L. However, the total area of all upstream perforations must be so small that they have no significant effect on the acoustic behavior of the muffler, which is then ensured if the total area of the upstream perforations, i.e. all perforations upstream of ⅜ of the length L, is less than 10% of the pipe cross-section of the branch pipe, in particular less than 5% of the pipe cross-section of the branch pipe.

Apart from the perforations, there are no other recesses in the branch pipe.

One advantage of the muffler according to the invention is that disturbing whistling noises are avoided to the greatest possible extent by damping pipe length resonances, in particular via the downstream perforations, without, however, destroying the desired acoustic function of the branch pipe. In addition, such a muffler can be manufactured easily and in a cost-effective manner.

In another example embodiment, a muffler for an exhaust system of an internal combustion engine, in particular for a motor vehicle, includes a housing, a through pipe which conducts exhaust gas during operation of the muffler and is guided through the housing, and a branch pipe fluidically branching off from the through pipe within the housing, it's the branch pipe has an upstream end at an through pipe and ends freely and open at the end face with a downstream end within the housing and has a lateral recess having a cross-sectional area which is greater than half the pipe cross-section of the branch pipe, the branch pipe having a length $L_1$ from the upstream end to the lateral recess, and having downstream perforations in a section from ⅜ of the length $L_1$ as measured from the upstream end, a total area of all downstream perforations together being less than half the pipe cross-section of the branch pipe, and no perforations or as previously explained no upstream perforations having a total area of at most 10% of the pipe cross-section of the branch pipe being present in a section upstream of ⅜ of the length L. In particular, the cross-sectional area of the lateral recess is greater than 75% of the pipe cross-section of the branch pipe. The lateral recess thus forms a main outlet opening of the branch pipe.

This muffler also has the advantage that disturbing whistling noises are avoided to the greatest possible extent by damping pipe length resonances, in particular via the downstream perforations, but without destroying the desired acoustic function of the branch pipe.

Unlike the previously described muffler, the length $L_1$ up to the lateral recess, in particular up to an edge of the recess closest to the upstream end of the branch pipe is measured instead of the length L up to the downstream end, since in this case, the resonance body extends between the upstream end of the branch pipe and the lateral opening.

The remaining features and advantages explained in connection with the previously described muffler also apply to the second muffler.

A particularly suitable region for the arrangement of downstream perforations is between ⅜ and ⅞ of the length L. The region from ½ to ⅞ of the length L is particularly preferred. An arrangement of perforations in the region 0 to ⅜ of the length L, which together have a cross-sectional area of more than 10% of the pipe cross-section of the branch pipe, would not only attenuate the pipe length resonance, but would also impair the acoustic function of the muffler.

The pipe length resonances in the branch pipe are damped particularly effectively if the downstream perforations are located in areas with high pressure pulsation.

In order to dampen different vibrational modes simultaneously, the downstream perforations can be divided into several subgroups, for example into two subgroups, the subgroups being spaced apart in the longitudinal direction. The longitudinal distance between the downstream perforations of a first subgroup and a further subgroup is significantly greater than the distance between the downstream perforations of a subgroup to each other. In other words, a pipe area that is free of perforations is present between the subgroups.

Perforations are for example arranged in the region ½ of the length L to dampen a first and third vibrational mode. Alternatively or additionally, perforations can be arranged in the region ¾ of the length L to dampen a second vibrational mode.

According to one embodiment, at least part of the downstream perforations is arranged circumferentially in a ring shape at the branch pipe. Pipe length resonances can be damped particularly effectively by perforations arranged circumferentially in a ring shape (i.e. along a radial plane), in particular if the perforations are arranged in a region in which high pressure pulsations occur during operation.

In order to dampen the pipe length resonance particularly effectively, several perforations can be arranged at different longitudinal positions in a ring shape, for example at ½ and at ¾ of the length L.

Alternatively or additionally, part of the downstream perforations may be arranged in a row along a longitudinal extension of the branch pipe. The row can, for example, extend from ½ to ⅞ of the length L. Such an arrangement of the perforations permit a sufficient damping of several vibrational modes.

Several rows, preferably two rows, of downstream perforations extending along a longitudinal extension may also be arranged side by side in the circumferential direction. Individual vibrational modes can thus be damped even better than in the use of one row.

The desired acoustic function of the branch pipe is hardly impaired by the embodiments described above.

According to a preferred embodiment, the downstream perforations each have a cross-sectional area between 3 $mm^2$ and 13 $mm^2$, in particular a cross-sectional area of 9.6 $mm^2$. A cross-sectional area in this range is particularly advantageous with regard to the damping of the pipe length resonances.

The downstream perforations, for example, have a circular or an elongated, slit-like cross-section. However, other shapes are also conceivable, such as elliptical or rectangular perforations.

The number of the downstream perforations is preferably between four and forty. With a smaller number of perforations, the pipe length resonance is not sufficiently damped in order to avoid undesired whistling noises to a sufficient extent. A larger number could impair the acoustic function of the branch pipe.

Depending on the application, it is also possible to provide perforations in the through pipe in addition to the downstream perforations in the branch pipe.

According to one embodiment, the pipe cross-section of the branch pipe is constant, but at least substantially constant (maximum 5% deviation). With a constant pipe cross-section, it is easier to predict the acoustic behavior of the muffler than with a varying pipe cross-section. In addition, a pipe having a constant cross-section is much easier and cheaper to manufacture than a pipe having a varying cross-section.

A diameter of the branch pipe is for example between 20 mm and 60 mm. In conventional mufflers, a suitable resonance frequency can be achieved with a diameter in this range. However, other pipe diameters are also possible depending on the size and the function of the muffler.

In order to obtain a compact design of the muffler, the branch pipe runs substantially parallel to the through pipe, at least in the region of its downstream end. This design permits to achieve a suitable, acoustically advantageous ratio of the muffler volume to the length of the branch pipe.

According to one embodiment, the housing is at least partially filled with an absorption material, in particular wherein the absorption material is adjacent to the perforations in order to achieve additional damping of undesired resonances. The absorption material may contain glass wool, rock wool or any other damping material.

According to one embodiment, the housing has at least one partition wall which divides the housing into partial chambers, the branch pipe being mounted on the partition wall. This has the advantage that low frequencies can be at least partially damped by sound reflection.

The muffler can include a Helmholtz resonator or a bypass muffler. Low-frequency noise components can also be well damped using such resonators. The branch pipe forms the neck of the Helmholtz resonator.

The branch pipe particularly preferably has a section which is curved in an arcuate manner and merges into a linear section extending up to the downstream end, the downstream perforations being present exclusively in the linear section. With such an arrangement of the downstream perforations, the desired Helmholtz resonance is only minimally affected, while the undesired pipe length resonance is damped.

The curved section is preferably curved by at least 90°, in particular 110°. In case of a curvature of 90°, the branch pipe runs substantially parallel to the through pipe at least in the region of its downstream end. In case of a larger or smaller curvature, the branch pipe runs inclined to the through pipe at least in the region of its downstream end. In this way, the muffler can be adapted to the installation space conditions.

BRIEF DESCRIPTION OF THE DRAWINGS

Further advantages and features of the present invention will become apparent from the description below and from the drawings below to which reference is made and which show.

DETAILED DESCRIPTION

Figure 1A:
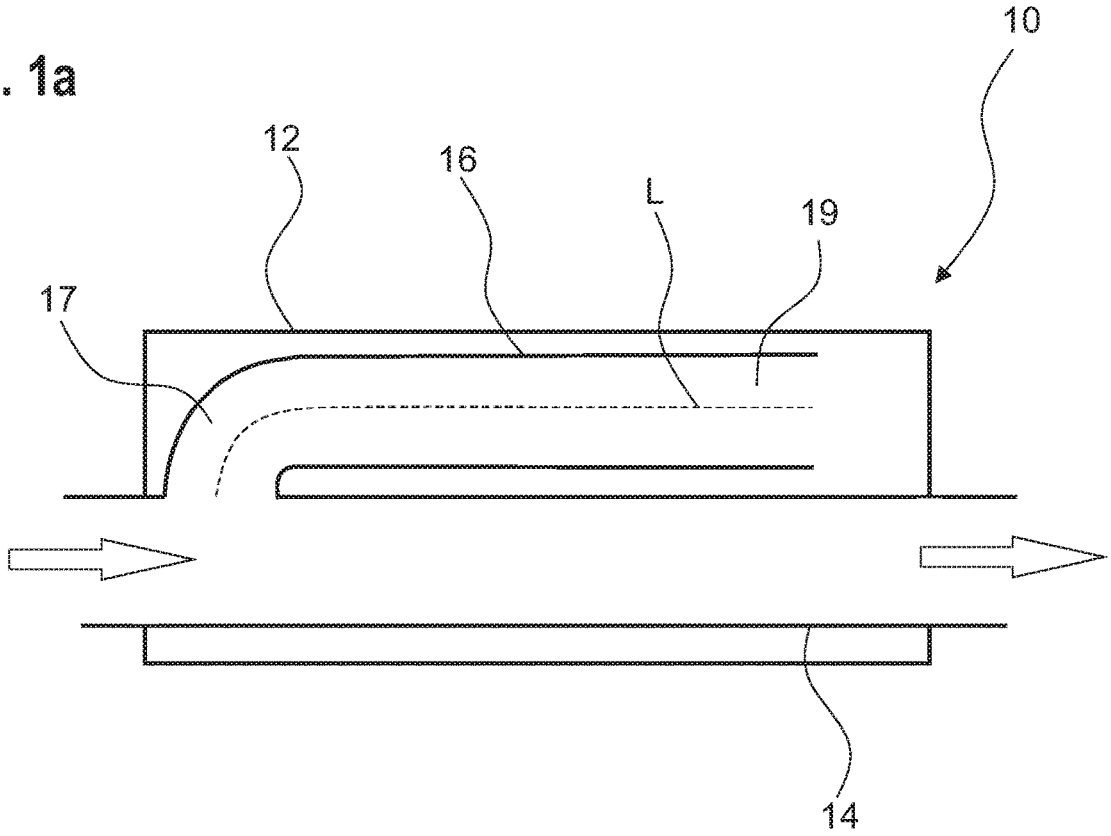
FIG. 1*a* schematically illustrates a longitudinal section through an exemplary muffler.

FIG. 1*a* schematically shows a longitudinal section of an exemplary muffler 10. The basic structure and the operating principle of a muffler 10 is to be explained on the basis of FIG. 1*a*.

The muffler 10 is suitable for an exhaust system of an internal combustion engine, in particular for a motor vehicle. The muffler 10 includes a housing 12 having a through pipe 14 which conducts exhaust gas during operation of the muffler 10 and which is guided through the housing 12, the exhaust gas flowing through the through pipe 14 in the direction of the arrow.

A branch pipe 16 fluidically branches off within the housing 12. The branch pipe 16 begins at the through pipe 14 with its upstream end and ends freely and open at the end face with a downstream end within the housing. A length L of the branch pipe 16 is measured from the upstream end to the downstream end at a center line of the branch pipe 16. This is illustrated in FIG. 1 by a dashed line L.

The branch pipe 16 runs substantially parallel to the through pipe 14 at least in the region of its downstream end. In particular, the branch pipe 16 has a section 17 curved in an arcuate manner which merges into a linear section 19 extending up to the downstream end. In the example embodiments shown, the curved section 17 is curved by 90°, but the curved section 17 can also be more or less curved, for example by 110°.

If the curvature of the curved section 17 essentially deviates from 90°, the branch pipe 16 extends inclined to the through pipe 14 at least in the region of its downstream end.

The pipe cross-section of the branch pipe 16 is substantially constant over the length L of the branch pipe 16.

The housing 12, for example, has a length of 400 mm and a volume of 5 liters. The through pipe 14, for example, has a diameter of 152 mm. The branch pipe 16, for example, has a length of 330 mm and a diameter of 35 mm. However, these values are only exemplary and can be varied as needed.

The muffler 10 includes a Helmholtz resonator. However, a valve can additionally be arranged in the through pipe 14, which can selectively close or open a flow path through the through pipe 14. In addition, a second outlet pipe can permit the escape of the exhaust gases out of the muffler when the valve is closed. This is referred to as a bypass muffler. If the valve of the bypass muffler is open to a maximum extent, the flow situation is the same as in a Helmholtz resonator. For the sake of simplicity, the sound situation in connection with a Helmholtz resonator is described below, the sound situation in a bypass muffler being however also meant here.

Figure 1B:
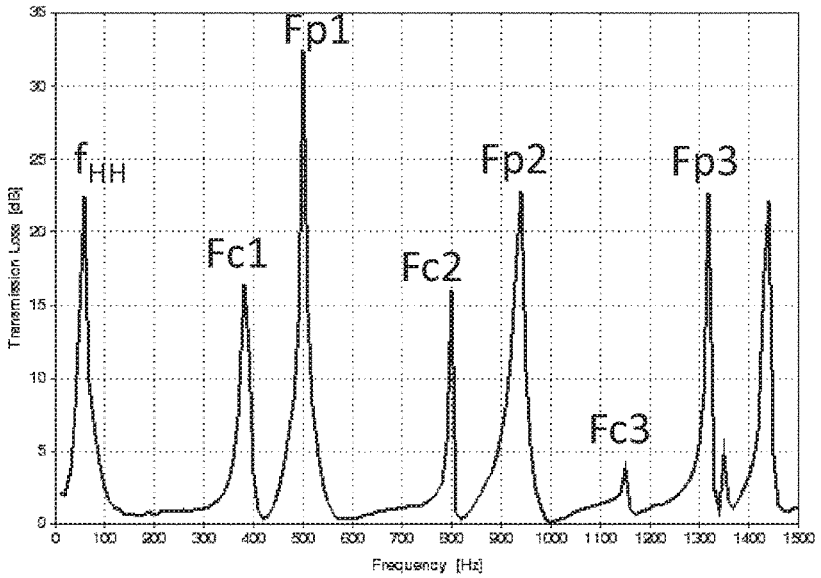
FIG. 1*b* is a diagram for illustrating the possible sound absorption using the muffler of FIG. 1*a*, FIGS. 2*a* to 8*a* each schematically illustrate a longitudinal section through a muffler according to the invention.

FIG. 1*b* shows a diagram for illustrating the possible sound absorption using the muffler 10 of FIG. 1*a*, a transmission loss in dB being plotted against the frequency in Hz.

A Helmholtz resonance $f_{HH}$ occurs in the range between 0 and 100 Hz. This resonance is advantageous in terms of sound absorption and should be as high as possible. Helmholtz resonance $f_{HH}$ is calculated according to the following formula:

$$f_{HH} = \frac{c}{2\pi} * \sqrt{\frac{A}{LV}}$$

c standing for the speed of sound, A for the cross-section of the branch pipe 16, L for the length of the branch pipe 16 and V for the volume of the housing 12.

Pipe resonances Fp1, Fp2 and Fp3 as well as housing resonances Fc1, Fc2 and Fc3 occur in addition to the Helmholtz resonance $f_{HH}$. The pipe resonances Fp1, Fp2, Fp3 and the housing resonances Fc1, Fc2, Fc3 cause interfering noises, in particular whistling noises, the pipe resonances being particularly disadvantageous with regard to noise development.

It is therefore an object of the invention to provide a muffler in which the disturbing resonances are damped, while the Helmholtz resonance $f_{HH}$ should remain as unaffected as possible.

For identical structures having identical functions which are known from the above embodiment, the same reference numbers are used in the following, and reference is made in this respect to the previous explanations, wherein the differences of the respective embodiments are discussed in the following to avoid repetitions.

Figure 2A:
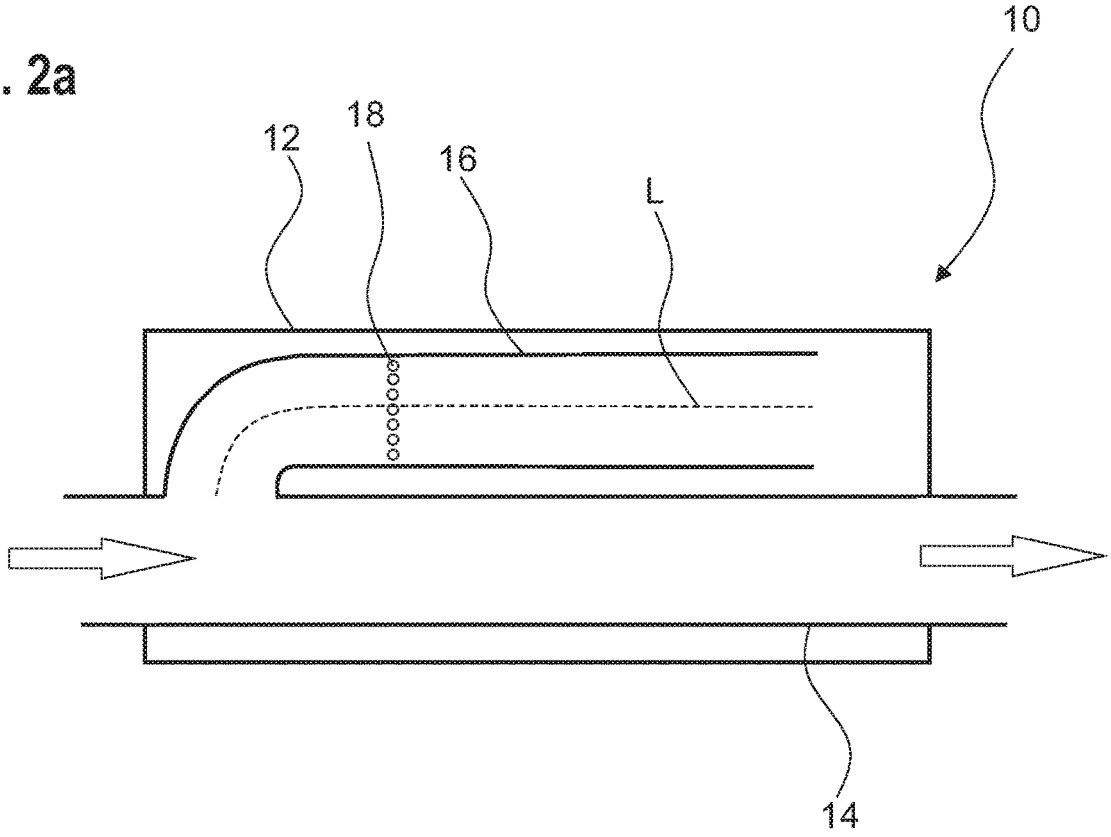
FIGS. 2*b* to 8*b* are each a diagram for illustrating the sound absorption using the respective muffler according to the invention, FIGS. 9, 10 and 11 each schematically illustrate a longitudinal section through a further embodiment of a muffler according to the invention, and FIG. 12 schematically illustrates a longitudinal section through a muffler according to the invention in an alternative embodiment according to the invention.

FIG. 2*a* schematically shows a longitudinal section through a first muffler 10 according to the invention. This muffler 10 differs from the muffler 10 in FIG. 1*a* in that the branch pipe has 16 perforations 18. Ten perforations 18 are, for example, provided. The number of perforations 18 drawn in the figures is for illustrative purposes only and does not necessarily correspond to the actual number of perforations 18.

The perforations 18 are arranged at a position of ⅜L and circumferentially in a ring shape on the branch pipe 16, more specifically as measured from the upstream end of the branch pipe 16, and are called downstream perforations.

The individual downstream perforations 18, for example, have a cross-sectional area between 3 $mm^2$ and 13 $mm^2$, particularly preferably of 9.6 $mm^2$. In particular, the cross-sectional area of the individual perforations 18 is small in comparison with a cross-sectional area of the branch pipe 18. The perforations 18 may be circular, slit-shaped, elliptical, rectangular or otherwise shaped. The perforations 18 are, for example, circular with a diameter of 3.5 mm.

As can be seen from the corresponding diagram in FIG. 2*a*, especially the pipe length resonance Fp1 is damped by such an arrangement of perforations 18. This can be explained by the fact that at position ⅜L, an increased pressure pulsation of a first vibrational mode occurs. The housing resonance at Fc1 is almost completely damped.

The damping of the resonances Fp1 and Fc1 results in significantly less disturbing noise occurring during operation of the muffler 10.

The Helmholtz resonance $f_{HH}$ is slightly damped, but is still within the acceptable range. The further pipe length resonances Fp2, Fp3 and the housing resonances Fc2, Fc3 are only slightly affected. The housing resonance Fc3, however, is very low anyway.

Figure 2B:
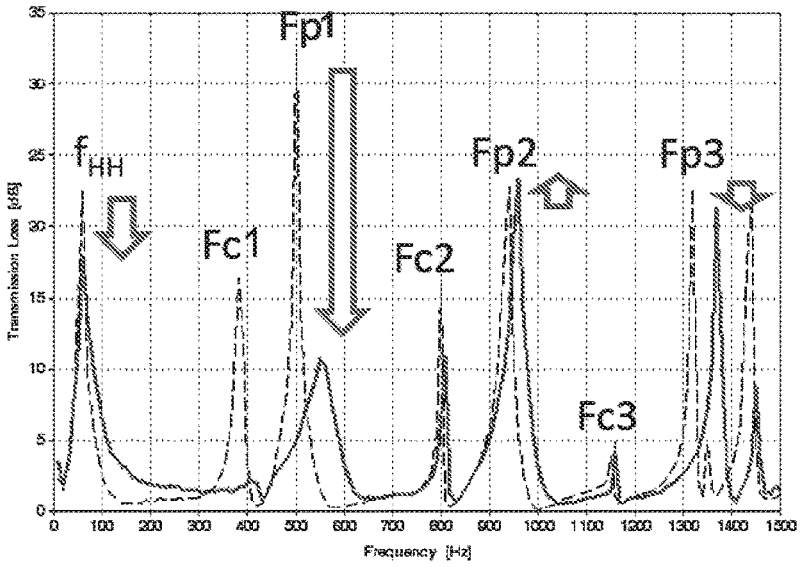

The initial values from the diagram according to FIG. 1*b* are plotted in FIG. 2*b* with a dashed line for better illustration. The optimized results obtained with a muffler 10 according to the invention as shown in FIG. 2*a* are marked with a solid line. In addition, the damping of the different resonances is illustrated by arrows. This also applies to the following FIGS. 3*b* to 8*b*.

If a change or damping of the resonances is mentioned below, this always refers to a change or damping with respect to the initial values according to FIG. 1*b*, unless otherwise described.

Figure 3A:
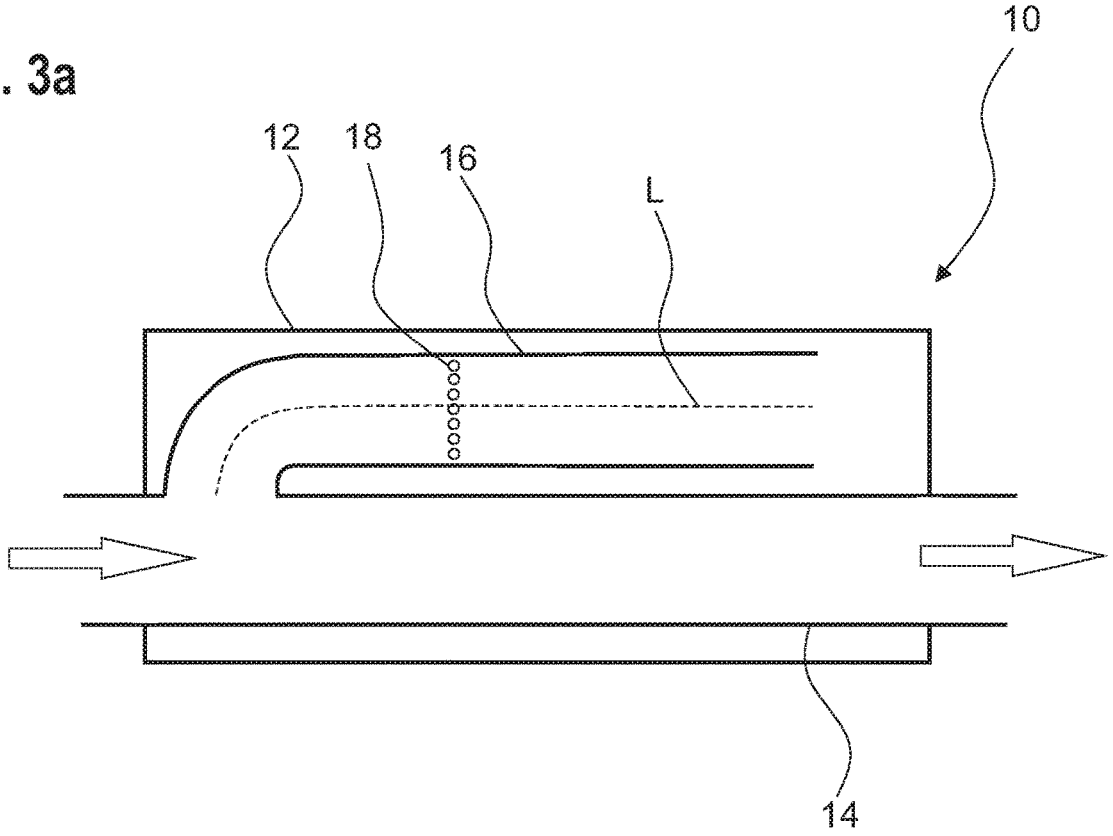

FIG. 3*a* schematically shows a longitudinal section through a further muffler 10 according to the invention. The muffler 10 according to FIG. 3*a* differs from the muffler 10 according to FIG. 2*a* in the position of the perforations 18. In particular, ten perforations are arranged at L/2, i.e. in the middle of the branch pipe 16.

Figure 3B:
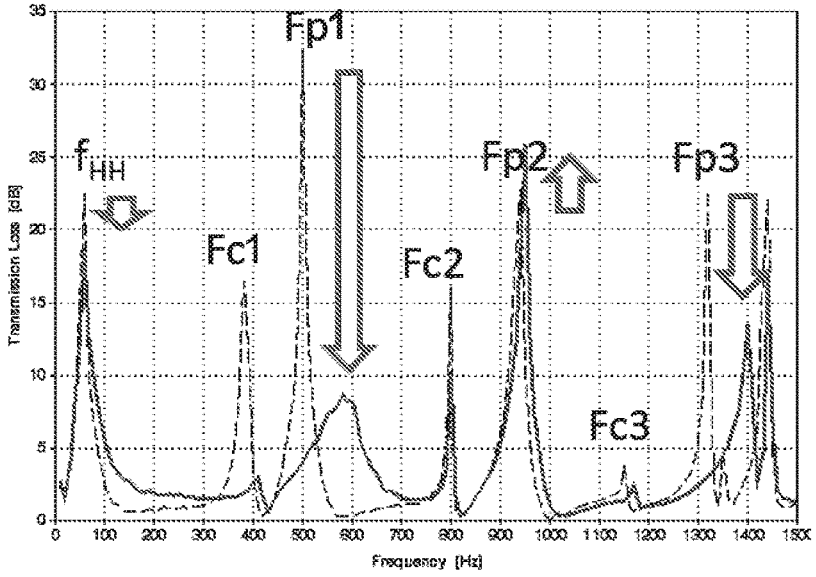

As can be seen from FIG. 3*b*, a very good damping of the pipe length resonance Fp1 is also achieved in this embodiment, while the Helmholtz resonance $F_{HH}$ is hardly influenced. Furthermore, a significant damping of the pipe length resonance Fp3 is achieved. The housing resonance Fc1 is also well damped.

Figure 4A:
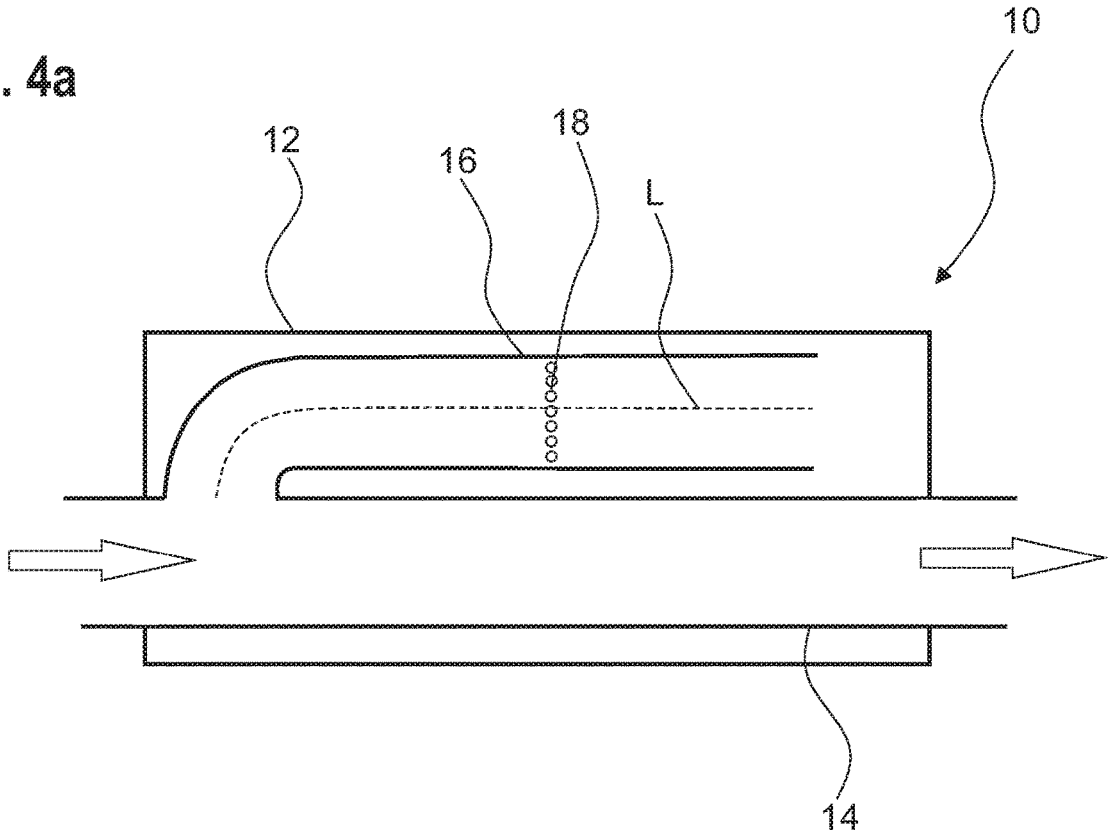

FIG. 4*a* schematically shows a longitudinal section through a further muffler 10 according to the invention. The muffler 10 according to FIG. 4*a* differs from the muffler 10 according to FIG. 2*a* in the position of the downstream perforations 18. In particular ten perforations are arranged at ⅝L.

Figure 4B:
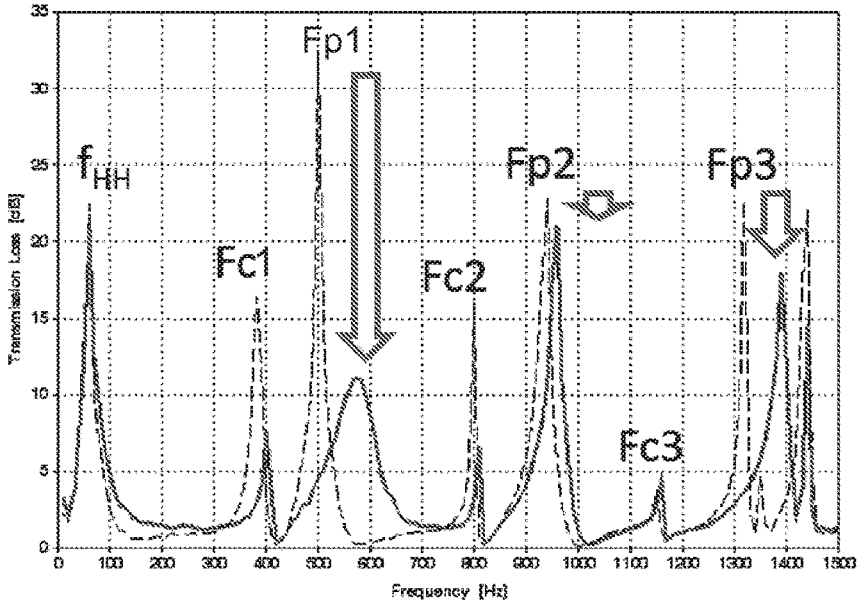

As shown in FIG. 4*b*, a very good damping of the pipe length resonance Fp1 is also achieved in this embodiment, while the Helmholtz resonance $F_{HH}$ is hardly influenced. The pipe length resonance Fp3 and the housing resonance Fc1 are damped less than in the embodiment according to FIG. 3, they are however still well damped.

Figure 5A:
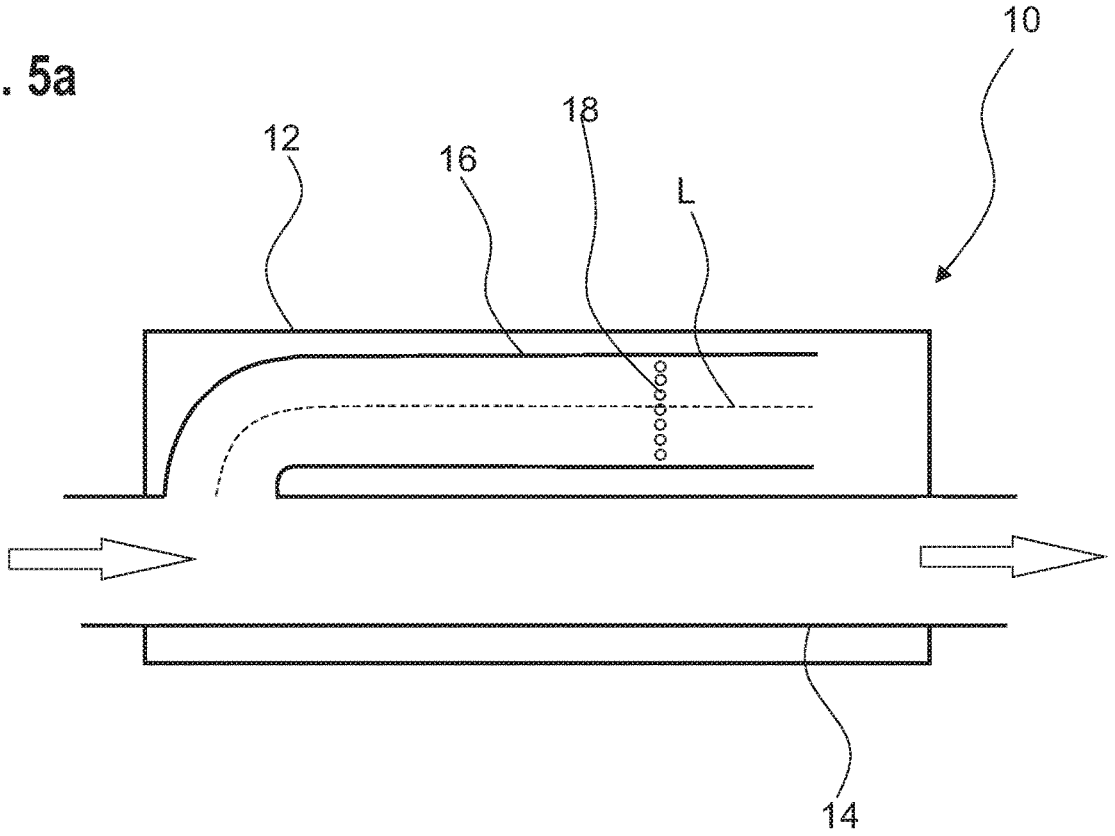

FIG. 5*a* schematically shows a longitudinal section through a further muffler 10 according to the invention. The muffler 10 according to FIG. 5*a* differs from the muffler 10 according to FIG. 2*a* also in the position of the downstream perforations 18. In particular ten perforations are arranged at ⅝L.

Figure 5B:
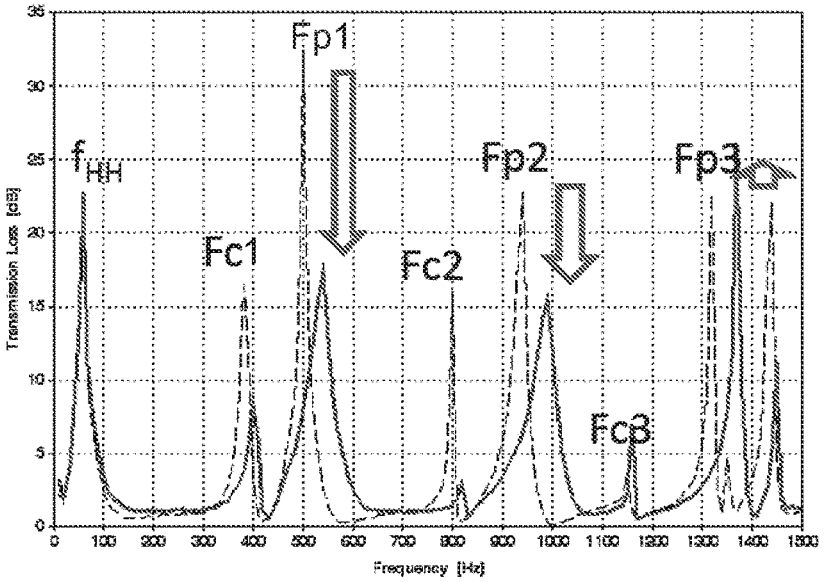

The diagram shown in FIG. 5*b* shows that the damping of the pipe length resonance Fp1 is somewhat worse than in the previous embodiments according to FIGS. 2*a* to 4*a*. However, the pipe length resonance Fp2, which remained almost unchanged in the previous embodiments compared to the initial situation, is significantly better damped. The Helmholtz resonance $F_{HH}$ is hardly influenced.

Figure 6A:
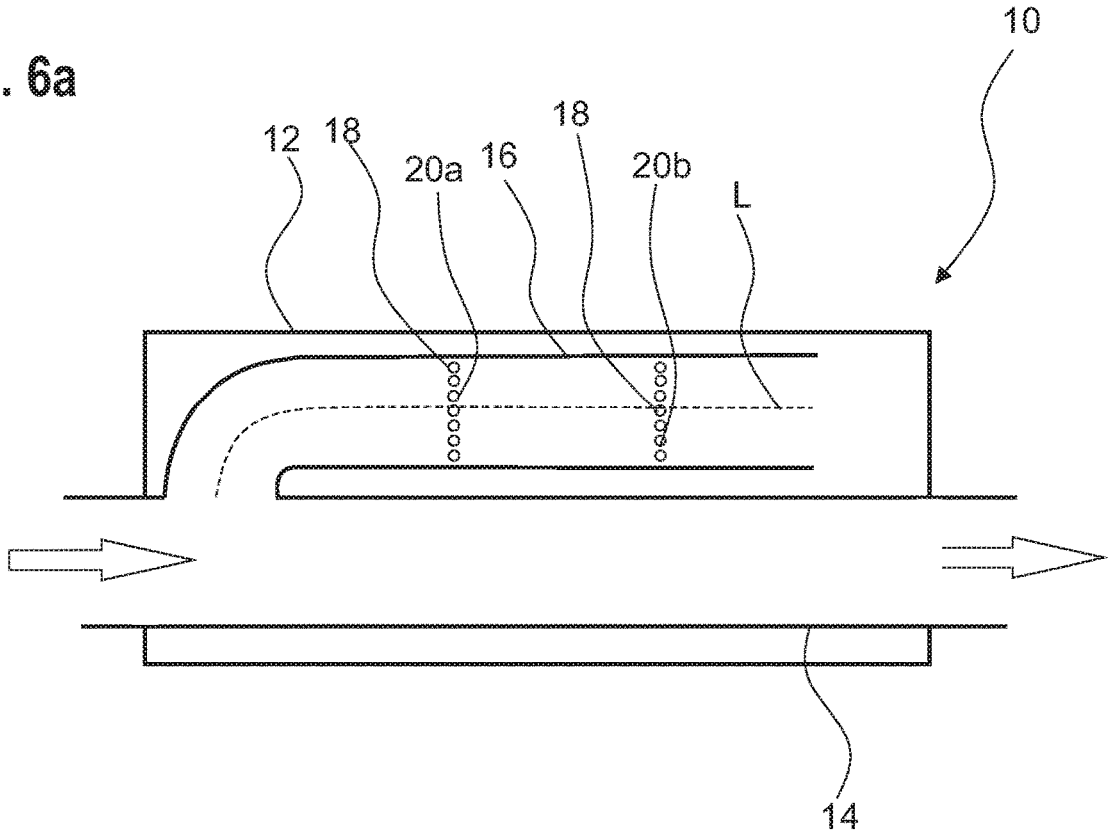
Figure 6B:
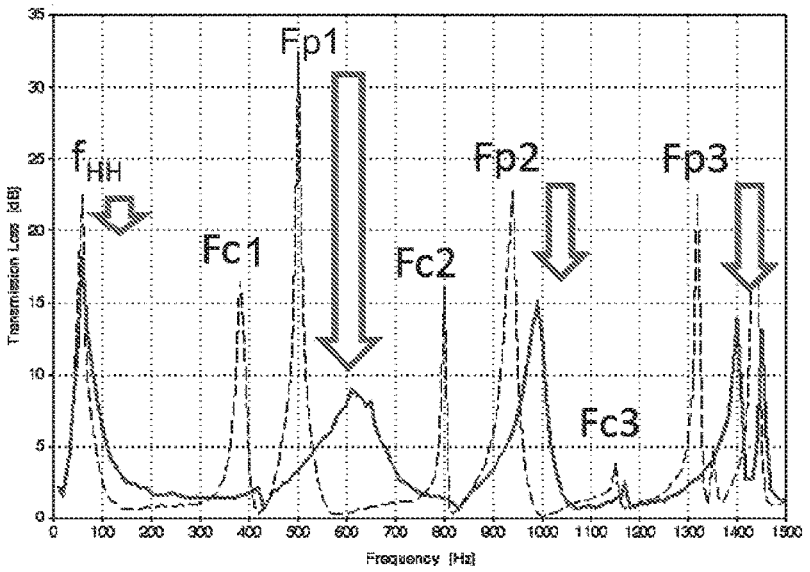

FIG. 6*a* schematically shows a longitudinal section through a further muffler 10 according to the invention. The muffler 10 according to this embodiment has two subgroups 20*a* and 20*b* of perforations 18. A first subgroup 20*a* of perforations 18 is arranged at L/2, and a further subgroup 18*b* of perforations 18 is arranged at ⅝L. The subgroups 20*a*, 20*b* each include ten perforations 18. The embodiment according to FIG. 6*a* is thus so to speak a combination of the embodiments according to FIGS. 3*a* and 5*a*. The position of subgroups 20*a*, 20*b* to each other can be varied as required.

The corresponding diagram of FIG. 6*a* shows that a very good damping of the resonances Fp1 and Fc1 is achieved in this embodiment. In addition, the pipe length resonances Fp2 and Fp3 are also significantly damped. The Helmholtz resonance $F_{HH}$ is hardly influenced.

In a further modification of the embodiment shown in FIG. 6*a*, more than two subgroups 20*a*, 20*b* may be provided, which may be arranged at equal distances or at distances of different size to each other. The subgroups may also have a different number of downstream perforations. A subgroup can, for example, have twenty perforations and another subgroup ten perforations.

Figure 7A:
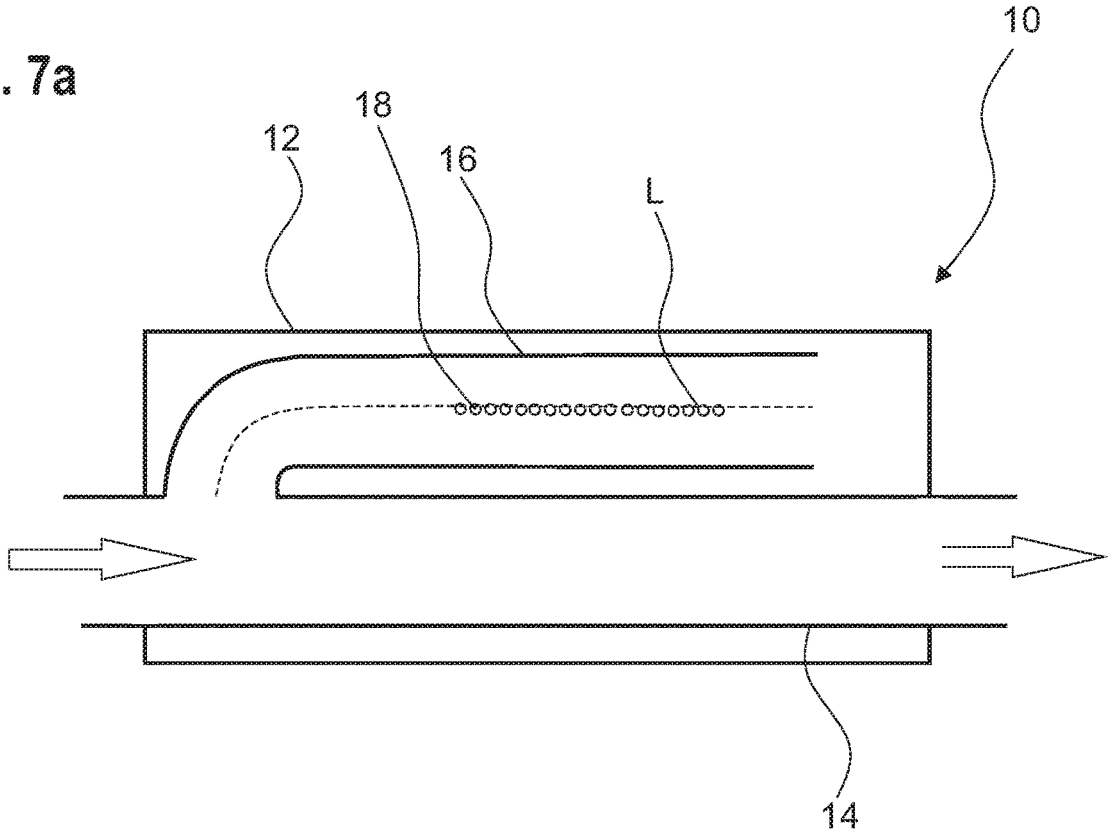

FIG. 7*a* schematically shows a longitudinal section through a further muffler 10 according to the invention. In this embodiment, the perforations 18 are not each arranged circumferentially in a ring shape as in the previous embodiments, but are arranged in a row along the longitudinal direction of the branch pipe 16, twenty perforations 18 being for example present.

The downstream perforations 18 are arranged in a region between L/2 and ⅞L.

Figure 7B:
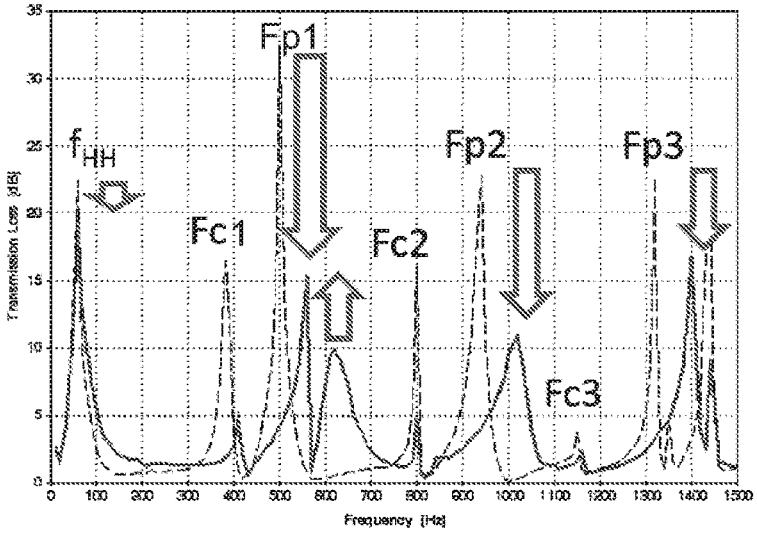

The diagram in FIG. 7*b* shows that in this embodiment, all pipe length resonances Fp1, Fp2 and Fp3 and also the housing resonances Fc1 and Fc2 are well damped. The Helmholtz resonance $F_{HH}$ is hardly influenced.

Figure 8A:
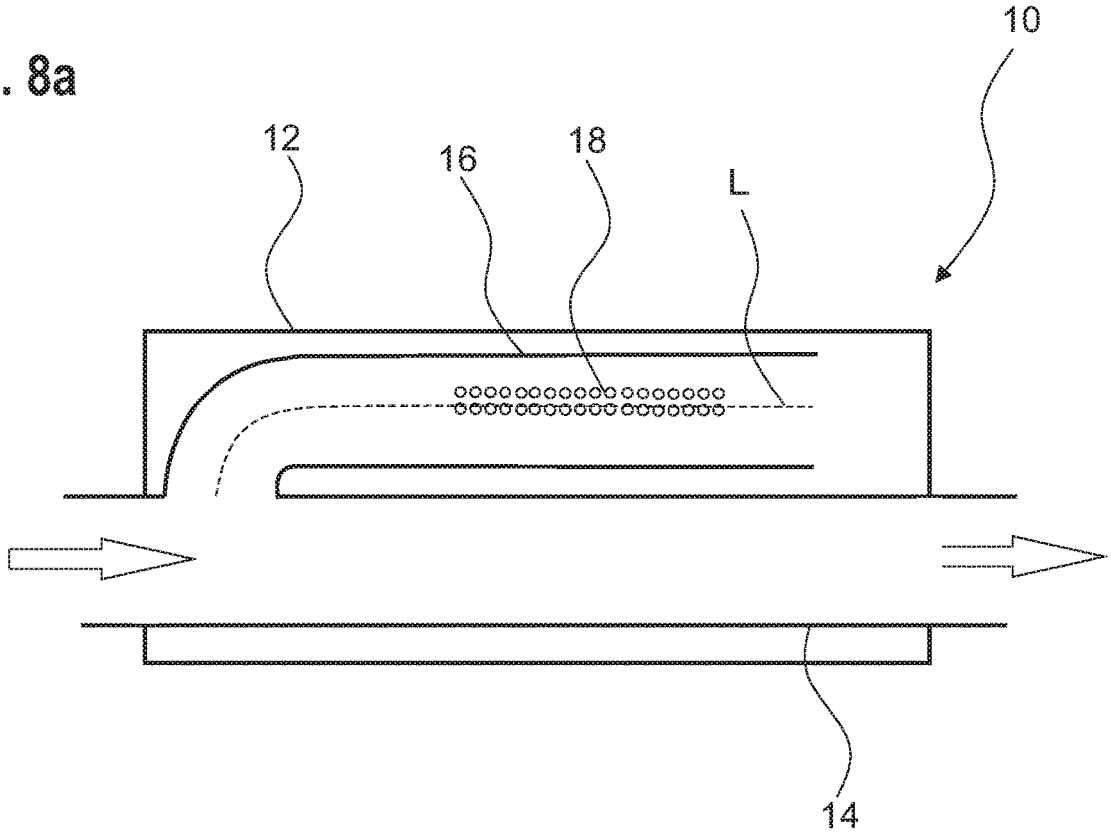

FIG. 8*a* schematically shows a longitudinal section through a further muffler 10 according to the invention. The embodiment according to FIG. 8*a* is similar to the embodiment according to FIG. 7*a*, but an additional row of perforations 18 is provided.

In particular, the perforations 18 extend in two rows along the longitudinal direction of the branch pipe 16, the rows being arranged side by side in the circumferential direction.

Each row has, for example, twenty downstream perforations 18, so that a total of forty perforations of 18 is provided.

Figure 8B:
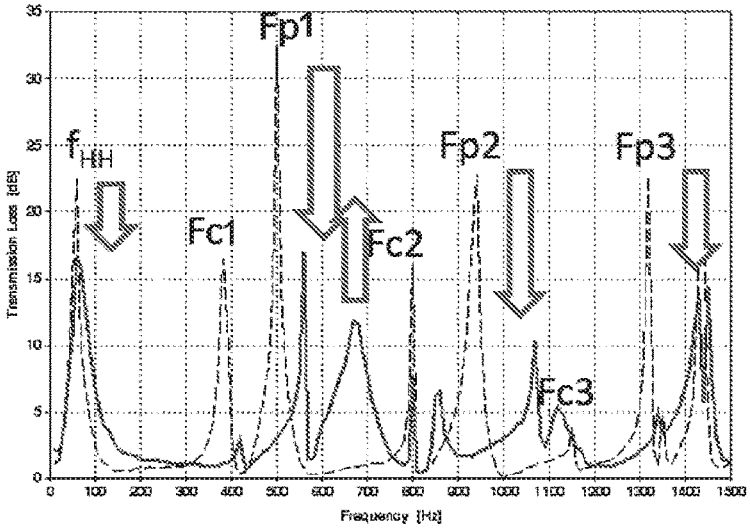

It results from the diagram shown in FIG. 8*b* that the pipe length resonances Fp1, Fp2 and Fp3 in a muffler 10 according to FIG. 8*a*, taken as a whole, are very well damped.

In a further embodiment that is not represented, a muffler 10 may have at least one subgroup of downstream perforations 18 extending in a row along the branch pipe 16, as shown in FIGS. 7*a* and 8*a*, and additionally at least one subgroup of downstream perforations 18 arranged circumferentially in a ring shape on the branch pipe 16, as shown in FIGS. 2*a* to 6*a*.

Figure 9:
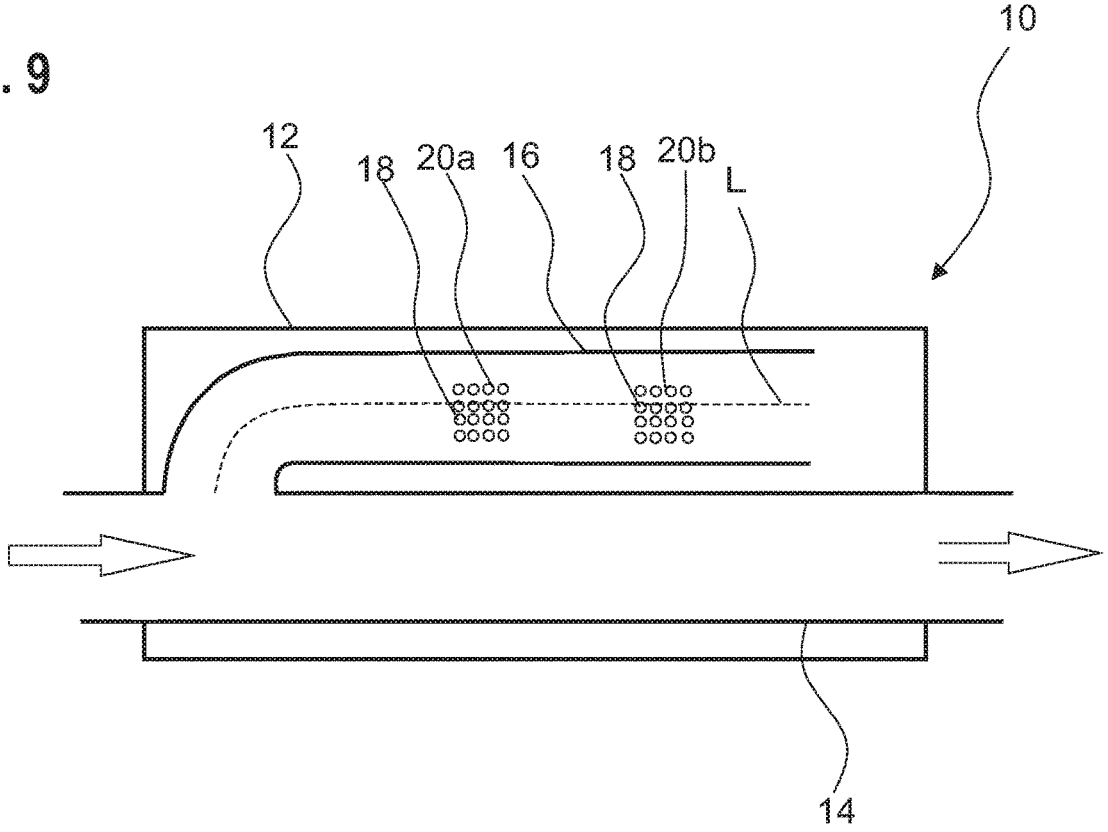

FIG. 9 shows a further embodiment according to the invention of a muffler 10 having two subgroups 20*a*, 20*b* of perforations 18. The perforations 18 of a subgroup 20*a*, 20*b* are each arranged in the form of a matrix, the downstream perforations 18 of a subgroup 20*a*, 20*b* forming in particular a rectangle.

Figure 10:
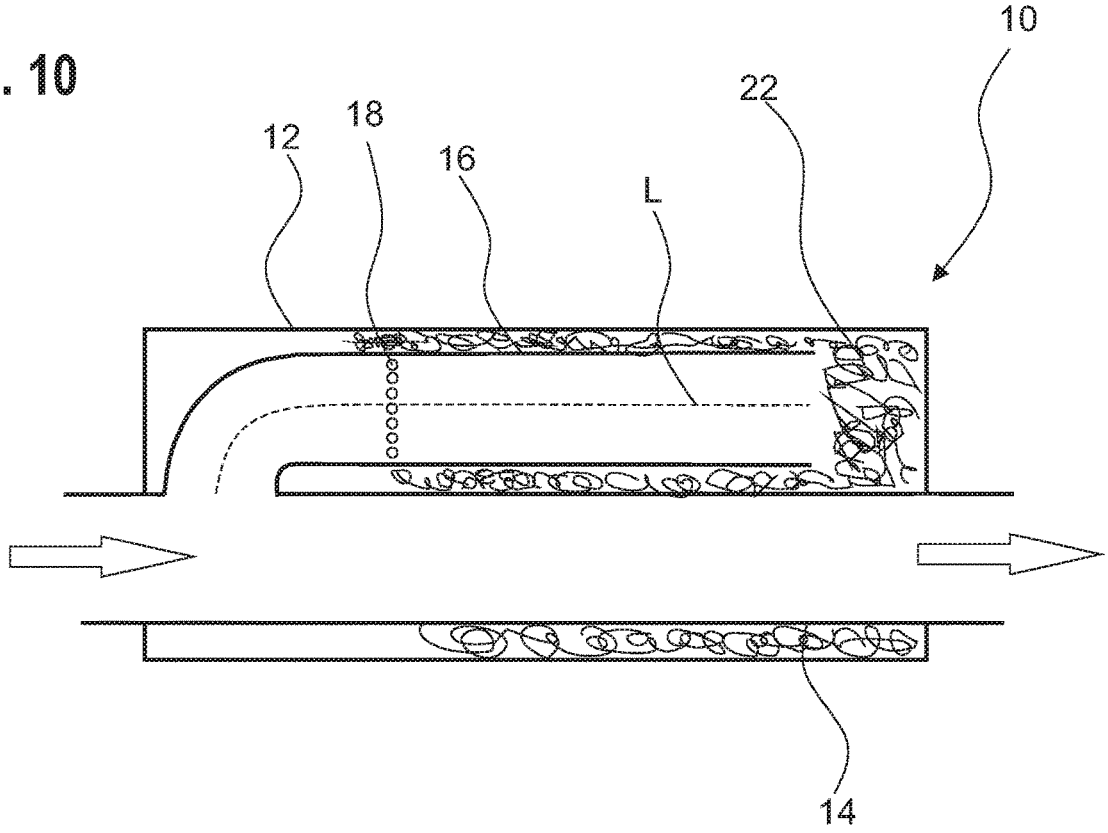

In order to achieve an even stronger damping of the various resonances, the housing 12 can be at least partially filled with an absorption material 22, in particular with the absorption material 22 adjoining the perforations 18. This is illustrated in FIG. 10.

Figure 11:
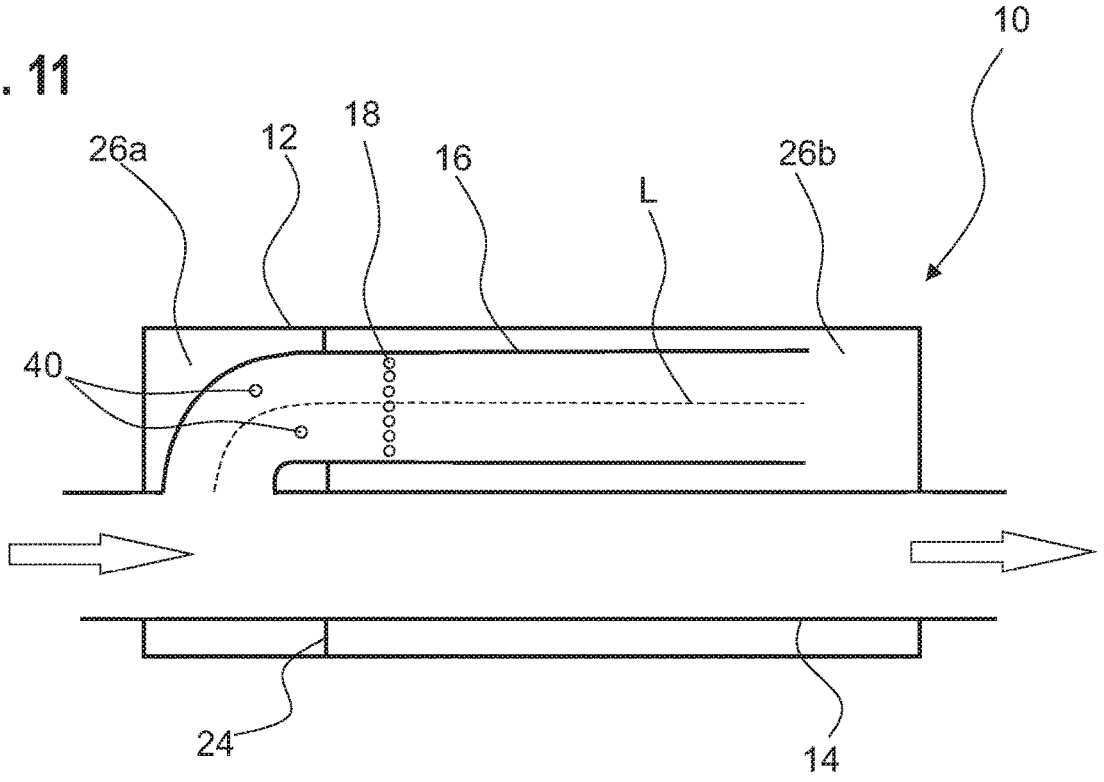

Furthermore, as shown in FIG. 11, the housing 12 may have at least one partition wall 24 dividing the housing 12 into partial chambers 26*a*, 26*b*, the branch pipe 16 being mounted on the partition wall 24.

All embodiments according to the invention of the muffler 10 have in common that a total area of the downstream perforations 18 is smaller than half the largest pipe cross-section of the branch pipe 16, the latter being measured in a radial plane to the center line of the branch pipe 16.

In addition, in all embodiments according to the invention of the muffler 10, the downstream perforations 18 are arranged in a section starting from ⅜L as measured from the upstream end of the branch pipe 16, in particular in the linear section 19 of the branch pipe 16. The number of the downstream perforations 18 is preferably between four and forty.

It is also conceivable that a few further perforations are arranged in a section before, i.e. upstream of ⅜L (see FIG. 11). These perforations are called upstream perforations 40 and can be present in all embodiments. However, the total area of these additional upstream perforations shall be so small that it has no appreciable effect on the acoustic behavior of the muffler 10. Therefore, the total area of the upstream perforations in the section before ⅜L must be less than 10% of the pipe cross-section of the branch pipe 16, preferably less than 5% of the pipe cross-section of the branch pipe 16. The total area of the perforations in the section before ⅜L is, for example, less than 50 $mm^2$.

Figure 12:
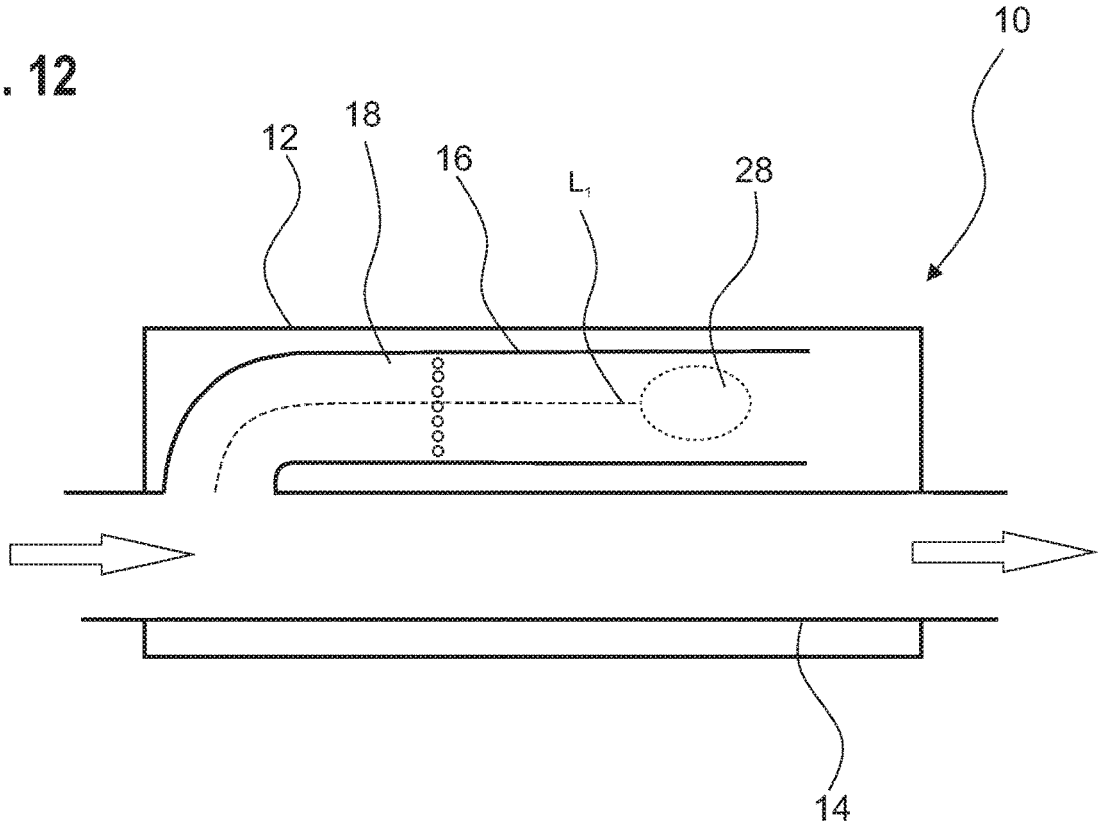

FIG. 12 schematically shows a longitudinal section through an alternative muffler 10 according to the invention. The muffler 10 according to FIG. 12 differs from the mufflers 10 according to FIGS. 2 to 11 in the presence of a large lateral recess 28. The recess 28 has a cross-sectional area which is greater than half the pipe cross-section of the branch pipe 16, in particular greater than 75% of the pipe cross-section of the branch pipe 16. The lateral recess 28 thus forms a main outlet opening of the branch pipe 16 opening into the housing 12.

In this case, instead of the length L up to the downstream end of the branch pipe 16, the length $L_1$ up to the lateral recess 28 is measured along the pipe center line to determine a position of the perforations 18. This is illustrated by the dashed line in FIG. 12.

The perforations 18 can in particular be arranged in a section from $\frac{3}{8}L_1$. In the embodiment shown, the perforations are arranged as an example at $L_1/2$, i.e. from this distance from the upstream end of the branch pipe 16.

The arrangement and number of downstream perforations 18 described in connection with FIGS. 2 to 9 can be transferred to the embodiment according to the invention of FIG. 12, wherein only the length $L_1$ has to be taken into account instead of the length L. However, for the sake of simplicity, these embodiments are not presented and described individually.

Furthermore, analogously to FIG. 10, the housing 12 of the muffler according to FIG. 12 may also be at least partially filled with an absorption material 22, in particular the absorption material 22 adjoining the perforations 18.

In addition, analogously to FIG. 11, the housing 12 may have at least one partition wall 24 which divides the housing 12 into partial chambers 26*a*, 26*b*, the branch pipe 16 being mounted on the partition wall 24.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A muffler for an exhaust system of an internal combustion engine, for a motor vehicle comprising:

a housing;

a through pipe which conducts exhaust gas during operation of the muffler and which is guided through the housing; and a branch pipe fluidically branching off from the through pipe within the housing, the branch pipe beginning with an upstream end at the through pipe and ending freely and open at an end face with a downstream end within the housing, the branch pipe having a length from the upstream to the downstream end and having downstream perforations in a section from ⅜ of the length as measured from the upstream end, a total area of the downstream perforations being smaller than half a pipe cross-section of the branch pipe, and no perforations or upstream perforations having a total area of at most 10% of the pipe cross-section of the branch pipe being present in a section before ⅜ of the length.

2. A muffler for an exhaust system of an internal combustion engine for a motor vehicle comprising:

a housing; a through pipe which conducts exhaust gas during operation of the muffler and which is guided through the housing; and a branch pipe fluidically branching off from the through pipe within the housing, the branch pipe beginning with an upstream end at the through pipe and ending freely and open at an end face with a downstream end within the housing and having a lateral recess with a cross-sectional area which is greater than half a pipe cross-section of the branch pipe, the branch pipe having a length from the upstream end to the lateral recess, and having downstream perforations in a section from ⅜ of the length as measured from the upstream end, a total area of the downstream perforations being smaller than half the pipe cross-section of the branch pipe, and no perforations or upstream perforations having a total area of at most 10% of the pipe cross-section of the branch pipe being present in a section before ⅜ of the length.

3. The muffler according to claim 1, wherein at least part of the downstream perforations is arranged circumferentially in a ring shape on the branch pipe.

4. The muffler according to claim 1, wherein at least part of the downstream perforations is arranged in a row along a longitudinal extension of the branch pipe.

5. The muffler according to claim 1, wherein the downstream perforations each have a cross-sectional area between 3 mm2 and 13 mm2.

6. The muffler according to claim 1, wherein the total number of the downstream perforations is between four and forty.

7. The muffler according to claim 1, wherein the pipe cross-section of the branch pipe is substantially constant.

8. The muffler according to claim 1, wherein the branch pipe extends substantially parallel to the through pipe at least in the region of the downstream end.

9. The muffler according to claim 1, wherein the housing is at least partially filled with an absorption material, and wherein the absorption material is adjacent to the downstream perforations.

10. The muffler according to claim 1, wherein the housing has at least one partition wall which divides the housing in partial chambers, and in that the branch pipe is mounted on the at least one partition wall.

11. The muffler according to claim 1, wherein the muffler has a Helmholtz resonator or a bypass muffler.

12. The muffler according to claim 1, wherein the branch pipe has a section curved in an arcuate manner which merges into a linear section extending up to the downstream end, the downstream perforations being present exclusively in the linear section.

13. The muffler according to claim 12, wherein the curved section is curved by at least 90°.

14. The muffler according to claim 2, wherein at least part of the downstream perforations is arranged circumferentially in a ring shape on the branch pipe.

15. The muffler according to claim 2, wherein at least part of the downstream perforations is arranged in a row along a longitudinal extension of the branch pipe.

16. The muffler according to claim 2, wherein the pipe cross-section of the branch pipe is substantially constant.

17. The muffler according to claim 2, wherein the housing is at least partially filled with an absorption material, and wherein the absorption material is adjacent to the downstream perforations.

18. The muffler according to claim 2, wherein the housing has at least one partition wall which divides the housing in partial chambers, and in that the branch pipe is mounted on the at least one partition wall.

19. The muffler according to claim 2, wherein the muffler has a Helmholtz resonator or a bypass muffler.

20. The muffler according to claim 2, wherein the branch pipe has a section curved in an arcuate manner which merges into a linear section extending up to the downstream end, the downstream perforations being present exclusively in the linear section.

* * * * *